US005520514A

United States Patent [19]

Mareix et al.

[11] Patent Number: 5,520,514

[45] Date of Patent: May 28, 1996

[54] SEALING LINING BETWEEN VANES AND INTERMEDIATE PLATFORMS

[75] Inventors: Jean-Pierre L. Mareix, Chartrettes; Philippe J.-P. Pabion, Le Mee sur Seine, both of France

[73] Assignee: Societe Nationale d'Etude et de Construction de Moteurs d'Aviation "SNECMA", Paris, France

[21] Appl. No.: 391,028

[22] Filed: Feb. 21, 1995

[30] Foreign Application Priority Data

Feb. 23, 1994 [FR] France ..... 94 02025

[51] Int. Cl.[6] ..... F04D 29/38

[52] U.S. Cl. ..... 416/193 A; 416/248

[58] Field of Search ..... 416/193 A, 248

[56] References Cited

U.S. PATENT DOCUMENTS

| | | | |
|---|---|---|---|
| 4,111,603 | 9/1978 | Stahl | 416/248 |
| 4,784,573 | 11/1988 | Ress, Jr. | 416/193 A |
| 5,156,528 | 10/1992 | Bobo | 416/248 |
| 5,222,865 | 6/1993 | Corsmeier | 416/193 A |
| 5,277,548 | 1/1994 | Klein et al. . | |
| 5,415,526 | 5/1995 | Mercadante et al. | 416/193 A |
| 5,421,704 | 6/1995 | Carletti et al. | 416/193 A |

FOREIGN PATENT DOCUMENTS

| | | |
|---|---|---|
| 0081416 | 6/1983 | European Pat. Off. . |
| 0488874 | 6/1992 | European Pat. Off. . |
| 2619158 | 2/1989 | France . |
| 1331209 | 9/1973 | United Kingdom . |
| WO93/22539 | 11/1993 | WIPO . |

*Primary Examiner*—John T. Kwon

*Attorney, Agent, or Firm*—Oblon, Spivak, McClelland, Maier & Neustadt

[57] ABSTRACT

Assembly for a rotor whose disk alternately bears vanes (1) and platforms (2). The plays (i.e. clearances) (7) are filled up with linings (15) composed of a mainly flexible casing (16) occupied by a small rod (20) which moves outwardly under the action of the centrifugal forces for filling up the play (7).

4 Claims, 5 Drawing Sheets

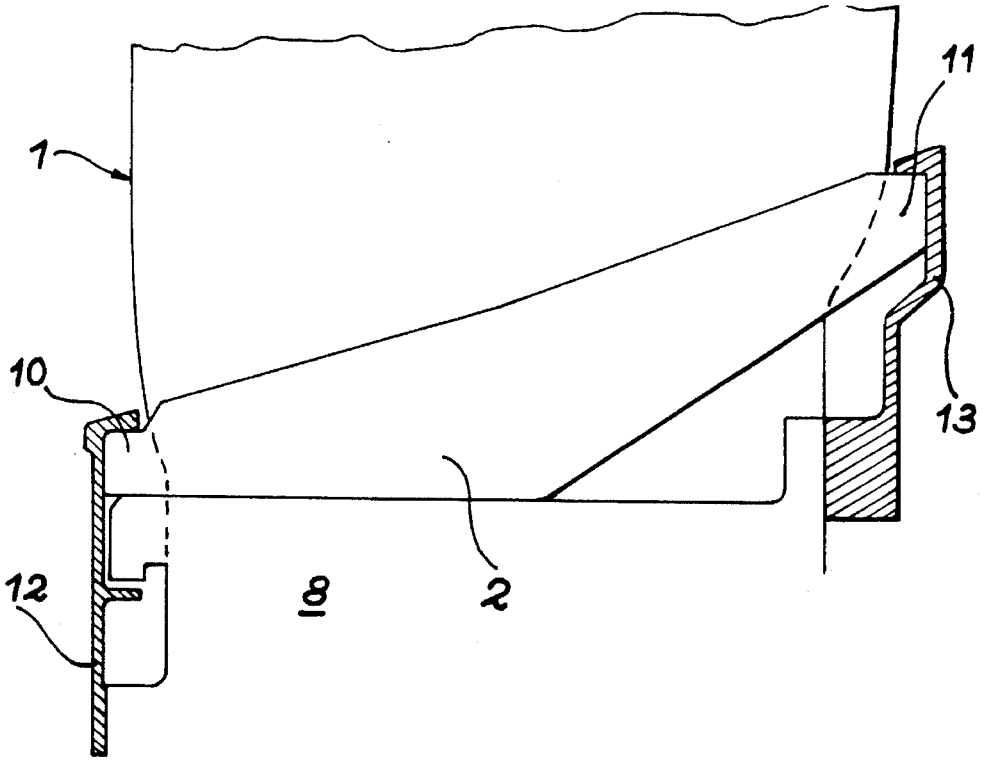
FIG. 2
FIG. 4
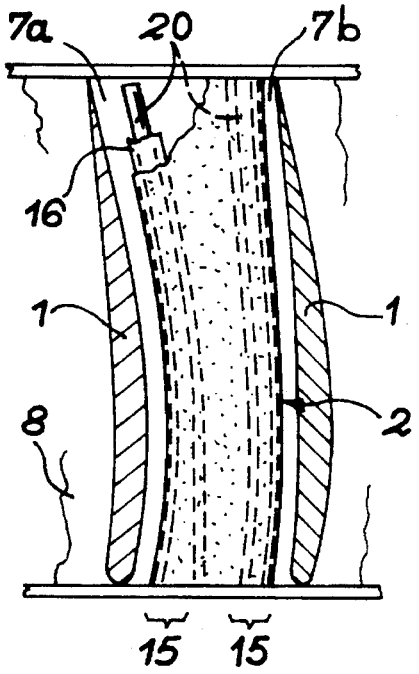

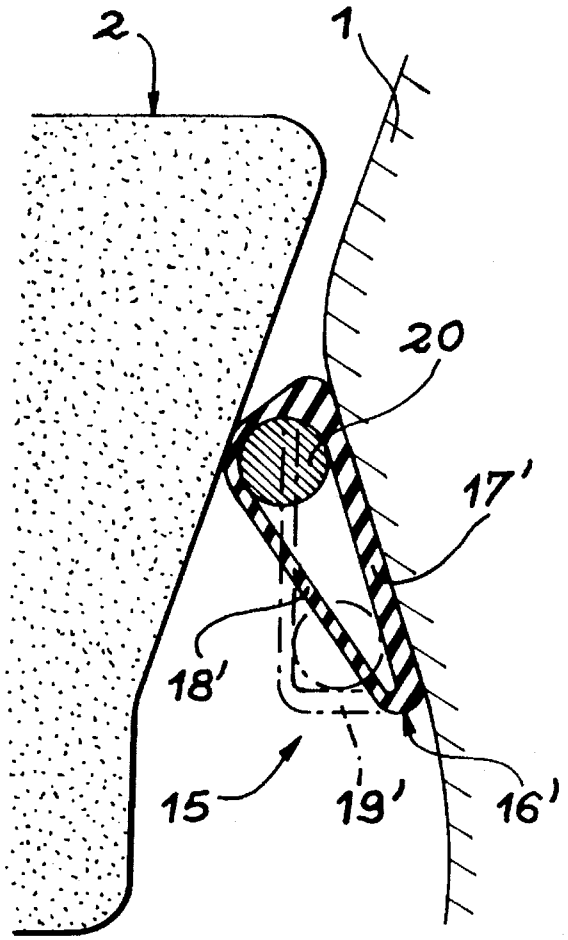
FIG. 7
FIG. 5
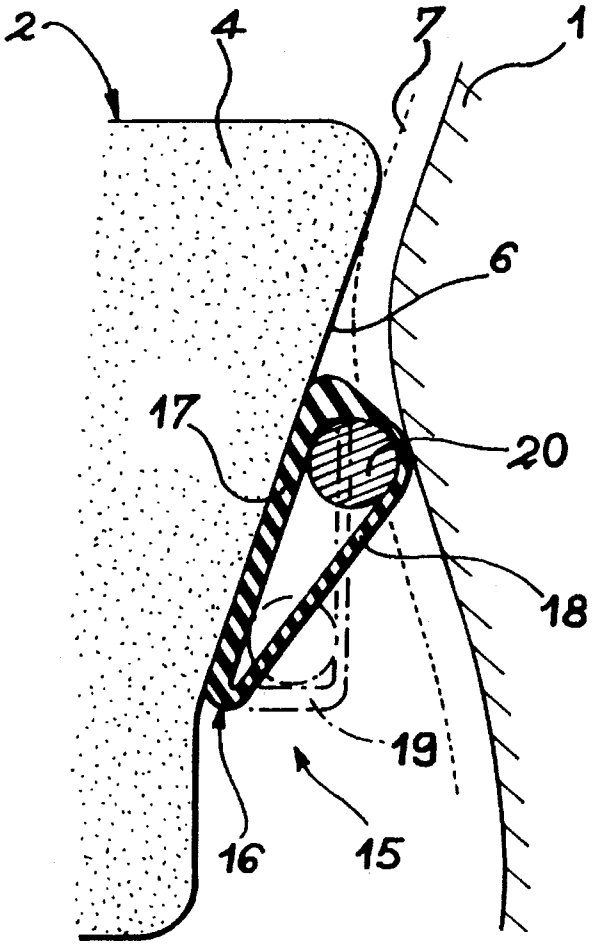

SEALING LINING BETWEEN VANES AND INTERMEDIATE PLATFORMS

FIELD OF THE INVENTION

The invention concerns a sealing lining disposed in an assembly of vanes on a blowing disk and intermediate platforms, thus forming a rotor.

BACKGROUND OF THE INVENTION

The most traditional design of vaned rotors, vital in particular in turbojet engines, consists of separately producing the disk of the rotor and the vanes and of assembling the latter on the disk by engaging the feet of the vanes on grooves of the disk. In fact, it is often advantageous to produce the vanes separately which are incurved parts whose shape is often complicated to embody.

Added to this is the difficulty of installing platforms between the vanes so as have the disk bordered by a circular smooth surface whose function is to delimit the gas flow vein, as these platforms are often elements mounted between the top side and bottom side of the adjacent vanes, which allows plays (i.e. clearances) to exist which destroy the continuity of the surface of the vein and which need to be to reduced as far as possible so as to avoid compromising the quality of the flow.

One current conception consists of producing the platform segments from a block with the vanes. Its details appear in a large number of patents and has the advantage of the fact that the platform segments meet together at mid distance from the vanes by straight joining points easy to fill up by a sealing lining. The drawback is that the platforms, whose extension is approximately perpendicular to that of the vanes, are complicated to produce.

Moreover, it is advantageous to lighten the rotor by producing these elements made of a composite material less exposed to forces, this possibly concerning the platforms and thus requiring that they be separated from the vanes.

SUMMARY OF THE INVENTION

The invention therefore is applicable to productions where the platforms are embodied as detached elements of the vanes and each extend between one pair of vanes, thus forming a play (i.e. clearance) with each of them, which unfortunately implies that the plays are significant along the vanes owing to the complex shape of said vanes and particularly as regards their curve and the need to dismantle the platforms. In one set of embodiments, the platforms are kept in position between the vanes by two ferrules, one being situated upstream of the rotor and the other downstream.

In one variant, the invention may also be applicable to a rotor whose platforms possess a foot housed in alveoles machined in the disk.

The invention concerns a sealing lining able to be placed in each of these plays and which fills them up correctly. In more detail, it concerns an assembly for a rotor composed of vanes embedded in the rotor and platforms situated between consecutive pairs of vanes, mainly longitudinal plays existing between the vanes and the platforms, this assembly being characterized in that it includes sealing linings occupying the plays and formed of a casing composed of a face bearing against the flanks of the platforms and one flexible face directed towards the surfaces of the vanes. Equally, the casing may be composed of a face bearing against the surfaces of the vanes and a flexible face directed towards the flanks of the platforms. Furthermore, the linings are again formed of a solid "long line" (i.e. elongated) element in the casing which may be sectorized or composed of a plurality of elements.

BRIEF DESCRIPTION OF THE DRAWINGS

There now follows a more detailed description of the invention with the aid of the annexed figures and given by way of non-restrictive illustration:

FIG. 2 is a cross section of the assembly representing a platform kept in place by upstream and downstream ferrules, FIG. 4 is a partially exploded top view, FIG. 5 is a detailed view of FIG. 3 and which illustrates the behaviour of the sealing lining when the engine rotates in accordance with the invention, FIG. 7 is a view similar to FIG. 5 and which shows a further embodiment of the invention.

DETAILED DESCRIPTION OF THE PREFERRED EMBODIMENTS

Figure 1:
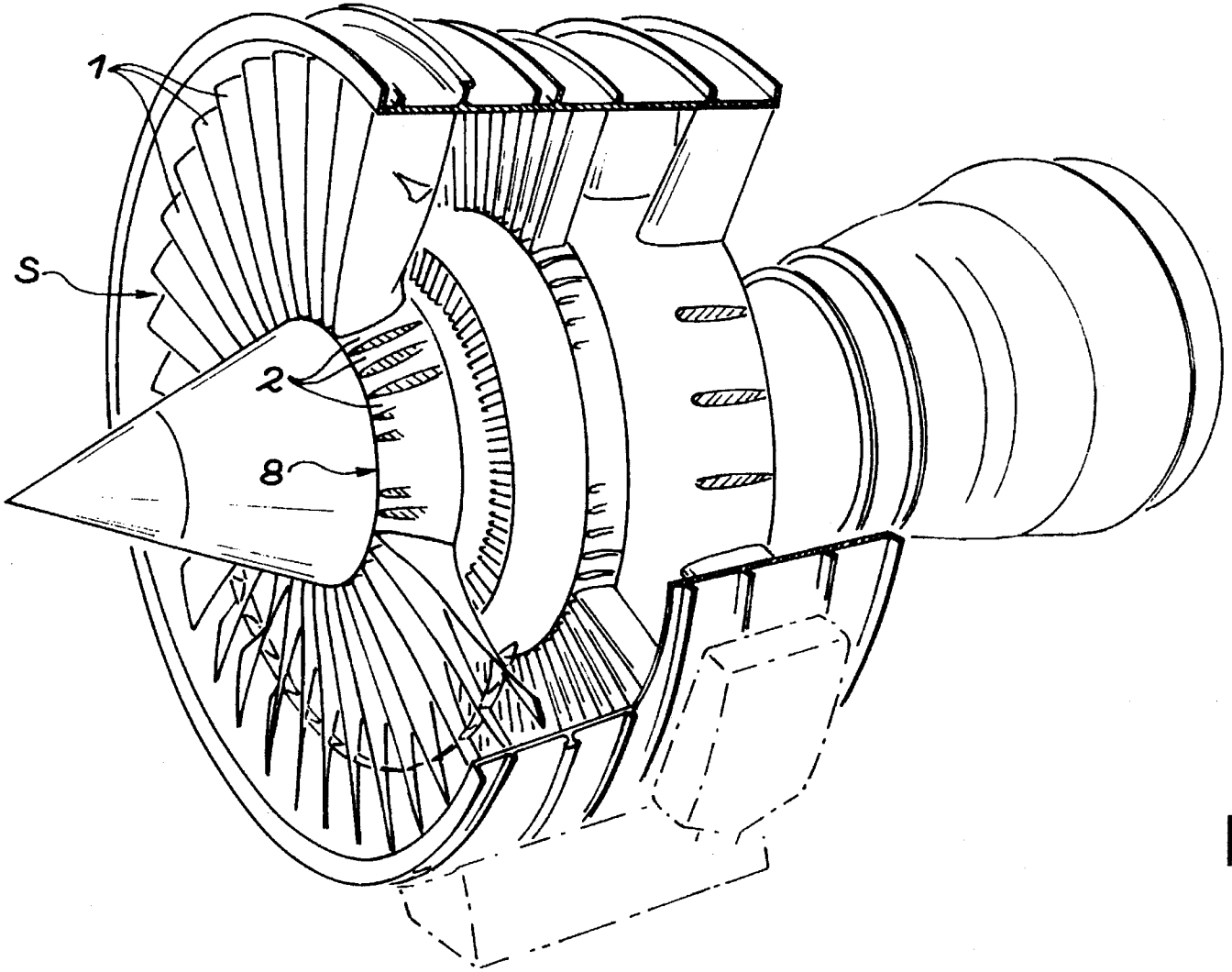
FIG. 1 is a general view of a machine where the invention is used.
Figure 3:
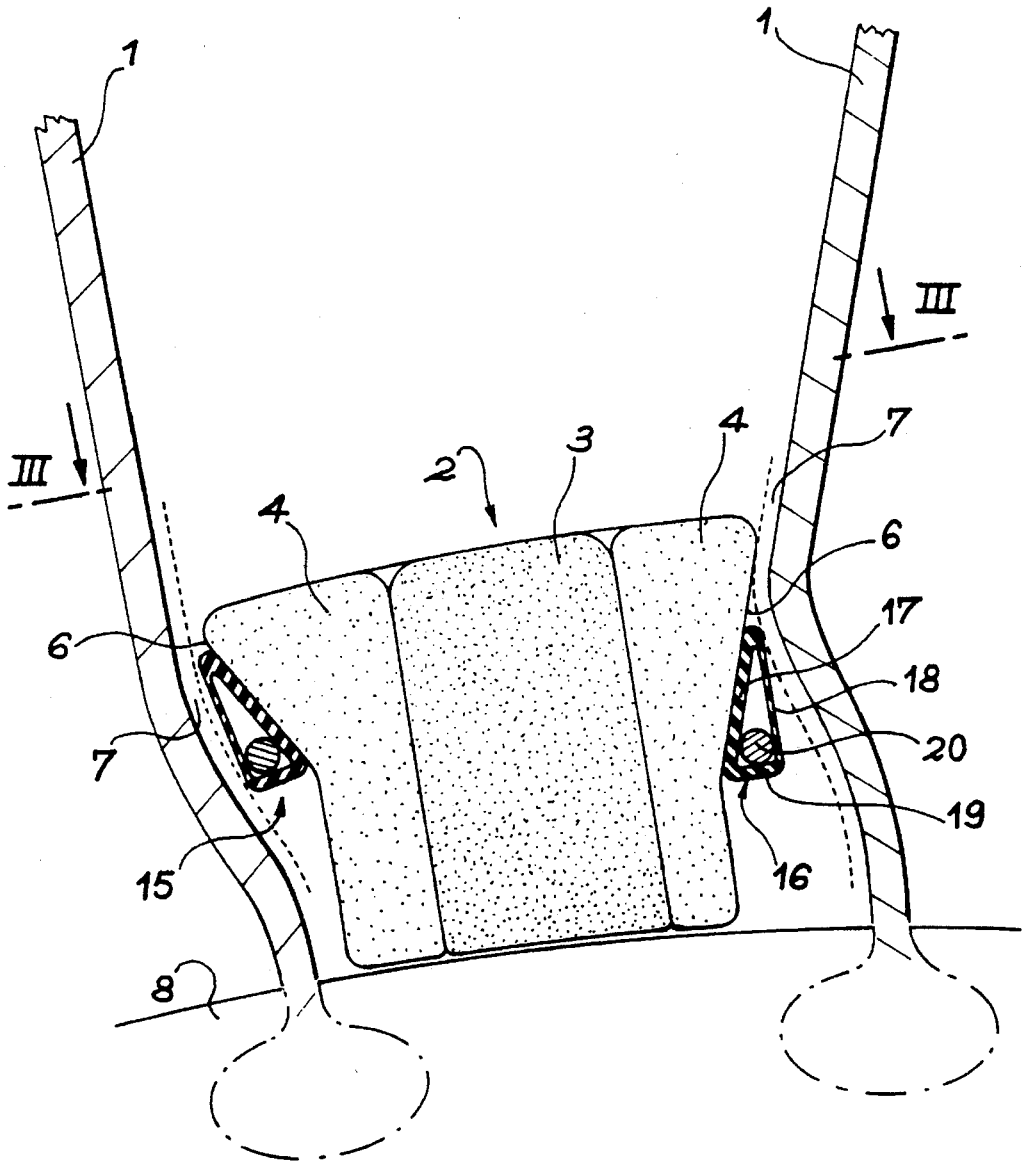
FIG. 3 is a section in the circumferential direction of the assembly of FIG. 2.

Reference is firstly made to FIGS. 1 to 3. FIG. 1 mainly shows a turbojet engine provided, as in the normal case, with several stages of compressors, turbines, etc., and which opens as shown on the left of the figure by an inlet blower S composed of a rotor disk 8 bearing a circular stage of radial vanes 1 which separate platforms 2 delimiting a flow vein. FIG. 3 shows two adjacent vanes 1 and an intermediate platform 2 composed of a central spar 3 and cores 4 on both sides of the spar 3. The cores 4 have external flanks orientated towards the vanes 1 and which bulge outwardly in a radial direction. The play (i.e. clearance) 7 with the vanes 1, determined by the mounting method, is merely a few millimeters.

The platform elements 2 are made of a composite material, which significantly lightens the rotor. FIG. 2 shows them extending over the entire length of the disk 8 and projecting on two sides by an upstream lengthening piece 10 and a downstream lengthening piece 11. An upstream ferrule 12 and a downstream ferrule 13 joined side by side to the lateral faces of the disk 8 and fixed to these faces according to known dispositions respectively cover the lengthening pieces 10 and 11 of the platform elements 2 and thus retain these elements against the axial and radial movements. In this embodiment, the platform elements 2 are supported by the ferrules 12 and 13 at several tenths of a millimeter from the surface of the disk 8.

The sealing linings which occupy the plays (i.e. clearances) 7 bear the general reference 15 on FIG. 3. Each is composed of a casing 16 formed of one internal face 17, one external face 18 and a radially internal heel 19. The section of the casing 16 is thus triangular as represented at the time the platform elements 2 are inserted. A rod-shaped "long line" (i.e. elongated) element 20 is engaged in the casing 16 and occupies one portion of the volume it includes. The rod 20 is not strictly flexible and may be made of a metal or composite material, yet its weight is sufficient to enable it to move in the casing 16 under the action of the centrifugal forces created during operation.

In fact, as shown on FIG. 5, the casing 16 is made of elastomer, its outer face 18 and the heel 19 are able to warp, and the rod 20 is free to slide inside the casing 16 towards the outside so as to draw close to the play 7 and fill it. The rod 20 is preferably cylindrical as regards all its sections so as to facilitate its sliding. The casing 16 then assumes the shape of a triangle whose point is directed in a radial direction towards the inside instead of being directed outwardly, The internal face 17 remains glued to the corresponding flank 6.

FIG. 4 shows a centripetal view of this embodiment of the invention. Each platform element 2 bears two similar sealing linings 15, even if the respective plays 7*a* and 7*b*, which separate the edge of the platform element 2 from the vanes 1 between which it is situated, may be different: the flexibility of the casing 16 makes it possible to fill the wide, though narrow, plays 7. It ought to be mentioned that the flanks 6 of the platform elements 2 are approximately parallel to the flanks of the vanes 1 and extend in front of the latter and that the sealing linings 15 are curved in a similar way. The plays 7 are thus filled over their entire length by an approximately uniform translation movement of the rods 20.

Figure 6:
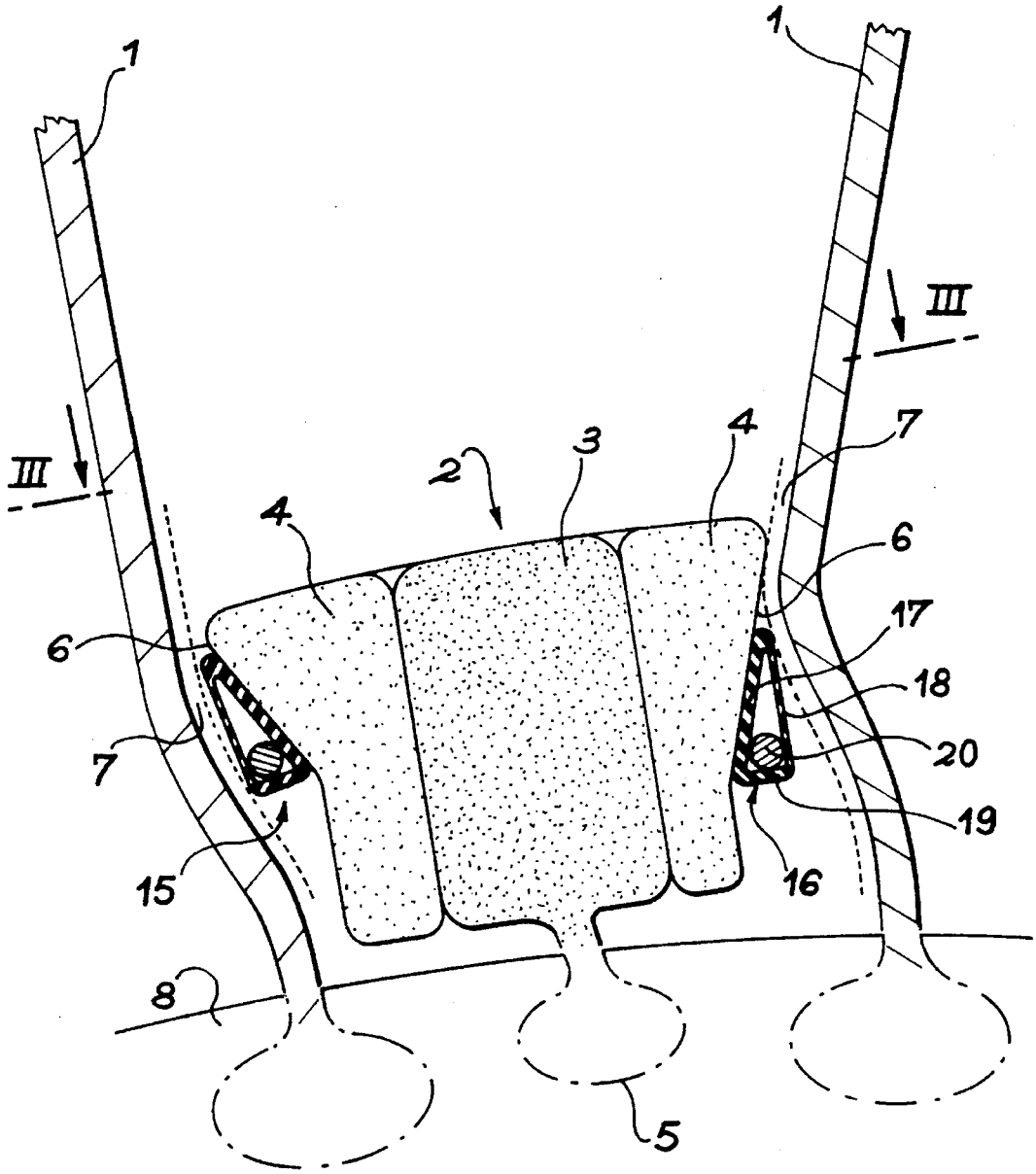
FIG. 6 is a section in the circumferential direction of one variant of the invention.

FIG. 6 shows an embodiment in which the platform elements 2, like the vanes 1, have a foot 5 engaged in an alveole of the disk 8 effected by a broaching. The ferrules 12 and 13 may then be omitted.

FIG. 7 shows a further embodiment of the invention in which the internal face, here 17', of the casing 16' of the sealing linings 15 is glued to the flank of the vane 1, and the outer face 18' and the heel 19' are directed towards the flank 6 of the platform 2. Functioning here is the same, as the centrifugal forces move the rod 20 towards the narrow portion of the play and thus fill it.

What is claimed is:

1. Assembly for a rotor and composed of vanes embedded in the rotor, platforms situated and kept in place between consecutive pairs of vanes, clearances, mainly longitudinal, existing between the vanes and the platforms, wherein said assembly includes sealing linings disposed in the clearances, said sealing linings each formed of a casing composed of one face bearing against a flank of one of the platforms, and one flexible face directed towards a surface of one of the vanes, said sealing linings being formed of a solid elongated element in the casing, said elongated element under the action of centrifugal force forcing said one flexible face directed toward a surface of one of the vanes into engagement with said surface during rotation of said rotor.

2. Assembly for a rotor and composed of vanes embedded in the rotor, platforms situated and kept in place between consecutive pairs of vanes, mainly longitudinal clearances existing between the vanes and the platforms, wherein said assembly includes sealing linings occupying the clearances during rotation of the rotor, said sealing linings each formed of a casing composed of one face bearing against a surface of one of the vanes and one flexible face directed towards a flank of one of the platforms, said sealing linings each further being formed of a solid elongated element in the casing, said elongated element under the action of centrifugal force forcing said one flexible face directed toward a flank of one of the platforms into engagement with said flank during rotation of said rotor.

3. Assembly for a rotor according to claim 1, wherein the rotor has a rotational axis and the casing, when the rotor is not rotating, has an approximately triangular section radially becoming thinner outwardly with respect to the rotational axis of the rotor.

4. Assembly for a rotor according to claim 2, wherein the rotor has a rational axis and the casing, when the rotor is not rotating, has an approximately triangular section radially becoming thinner outwardly with respect to the rotational axis of the rotor.

* * * * *